US007909200B1

(12) United States Patent
Horne

(10) Patent No.: US 7,909,200 B1
(45) Date of Patent: Mar. 22, 2011

(54) WASTEBASKET

(76) Inventor: Daniel James Horne, Naples, FL (US)

( * ) Notice: Subject to any disclaimer, the term of this patent is extended or adjusted under 35 U.S.C. 154(b) by 444 days.

(21) Appl. No.: 11/893,967

(22) Filed: Aug. 17, 2007

(51) Int. Cl.
*B65F 1/06* (2006.01)

(52) U.S. Cl. ..... 220/495.08; 220/908.1; 220/495.11

(58) Field of Classification Search ..... 220/495.08, 220/909, 908, 908.1, 495.11
See application file for complete search history.

(56) References Cited

U.S. PATENT DOCUMENTS 1,736,192 A * 11/1929 Easton ..... 220/495.08
2,500,466 A * 3/1950 Myers ..... 220/495.08
4,951,831 A * 8/1990 Roesch et al. ..... 220/676
4,974,746 A * 12/1990 Dickinson ..... 220/495.09
5,579,915 A * 12/1996 Liss ..... 206/554
6,059,138 A * 5/2000 Labruyere ..... 220/574
6,123,215 A * 9/2000 Windle ..... 220/495.07

* cited by examiner

*Primary Examiner* — Stephen Castellano
(74) *Attorney, Agent, or Firm* — IP&L Solutions; Edward K Welch, II

(57) ABSTRACT

A wastebasket has one or more openings on one or more sides thereof. The openings extending from near the top of the wastebasket and terminate near the bottom of the wastebasket. The one or more openings allow a part of the wastebasket on either side of each opening to move outwardly under the pressure of being stuffed, and particularly when overstuffed by pushing the trash down in the plastic bag to create more room at the top of the wastebasket. The lower end of the one or more openings relieves an air pressure differential between an installed trash bag and the wastebasket with just a little movement upward of the trash bag.

18 Claims, 2 Drawing Sheets

Fig 1
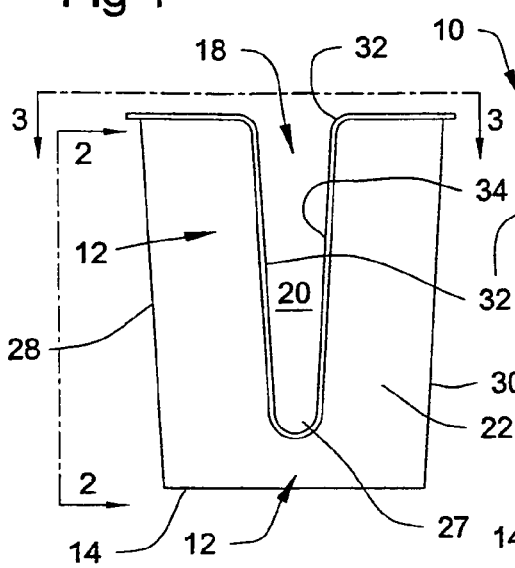
Fig 2
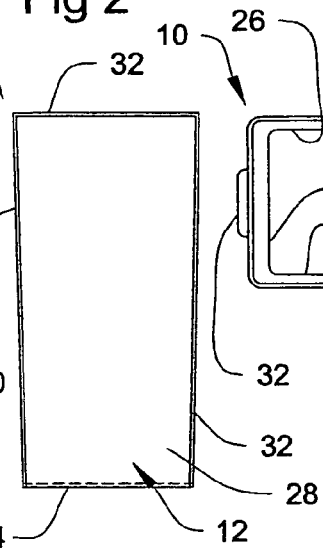
Fig 3
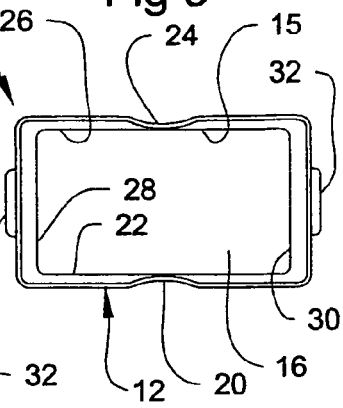
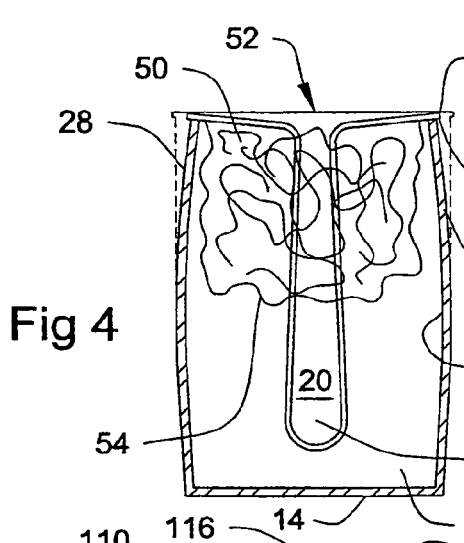
Fig 4
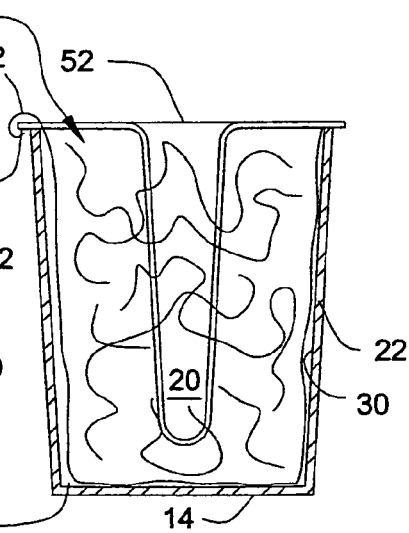
Fig 5
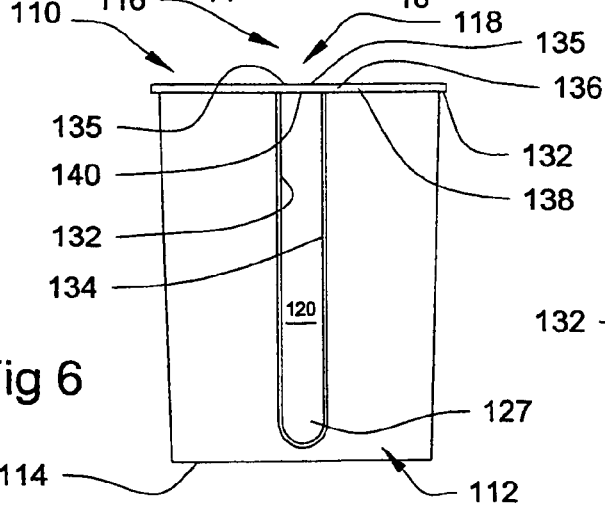
Fig 6
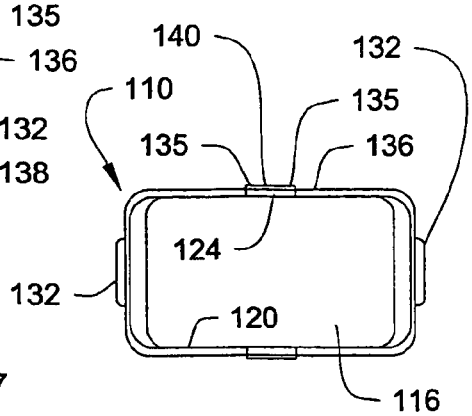
Fig 7

Fig 8
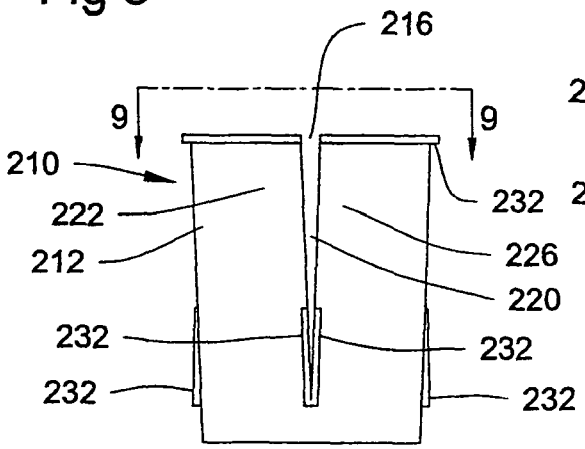
Fig 9
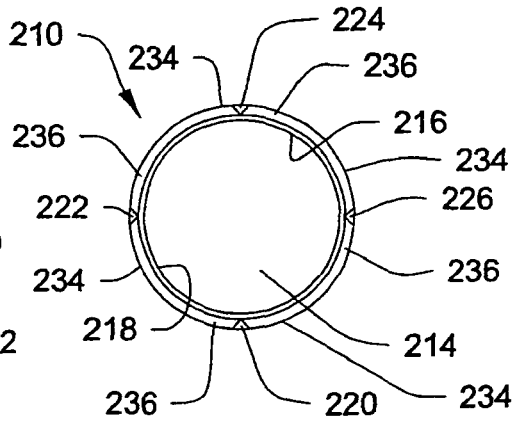
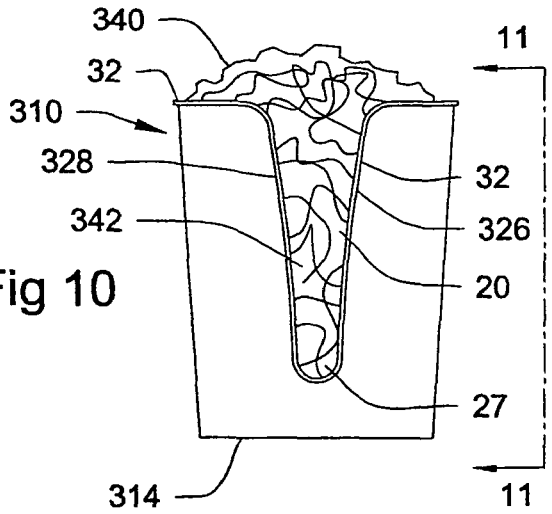
Fig 10
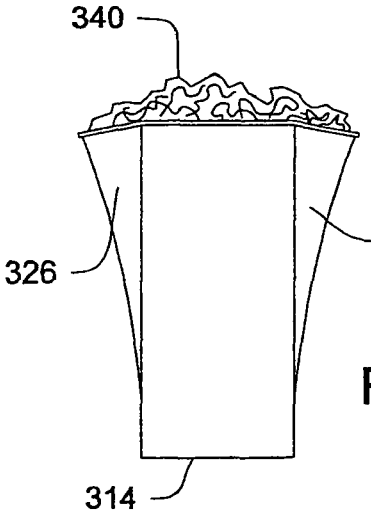
Fig 11
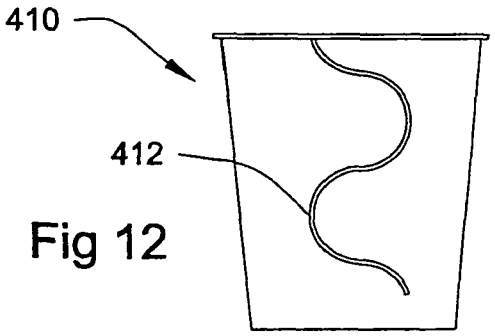
Fig 12
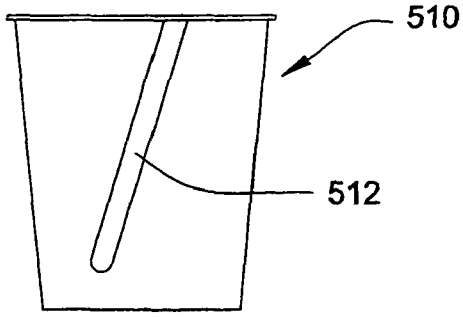
Fig 13

WASTEBASKET

BACKGROUND OF THE INVENTION

Wastebaskets have been used with a plastic bag inserted so that the waste that is put into the wastebasket can be easily removed and properly disposed. Also, most wastebaskets are constructed much like an inverted, truncated, cone or pyramid with a non-circular base. That is, their side, whether round, oval, square, or rectangular in cross-section, has an outward taper, making the bottom of the wastebasket interior smaller than the top of the wastebasket interior. Wastebaskets are now usually made of plastic and, in effect, they are large containers that are waterproof and can receive certain trash bags, also usually of plastic. There are two relatively independent problems with such typical wastebaskets that the invention addresses. Both problems arise because of the manner of use when using trash bags, also usually plastic.

The first problem has to do with the use of oversized trash bags. Typically, the plastic bag used is somewhat bigger than the wastebasket itself. It is therefore inserted into the wastebasket, and because the plastic bag is larger than the wastebasket, a problem often arises. When putting a plastic trash bag into the typical wastebasket, the open bottom of the bag is inserted through the top of the basket, and the bag's top is still considerably larger than a typical open top of a wastebasket, so it is just wadded up, or is sometimes tied into knot so that it will stay reasonably tight on the rim of a wastebasket. Quite often users will use large rubber bands or bungee cords around the bag top and the wastebasket rim, holding the bag in place. This is cumbersome and time-consuming. The invention herein disclosed and claimed also solves this problem.

The second problem is that, while using an overly large trash bag in any wastebasket, including the ones shown herein, often the tendency is to try to get as much trash in the trash bag as possible, at least in part because of the time and effort involved in getting the rubber band or an equivalent off when using the typical wastebasket, then tying the bag so that the contents will not spill, or having no other trash bags readily available at the moment. This often results in overstuffing the bag, pushing the waste down to compact it so that just a little more can be put in it, resulting in the bag acting much like a seal with the inner wall of the wastebasket, making it more difficult to remove the filled bag. This can also occur concurrently with the first problem, trying to put just a little more trash in, even without trying to overstuff the trash bag. Whether or not the wastebasket is tapered, when the engagement of the wastebasket side wall or walls by a plastic bag that has been filled fits very tightly, particularly in the lower half of the trash bag, it likely that the lower part of the bag becomes filled with a higher concentration of heavier waste material, whether or not the material has been pushed downwardly until the bag is absolutely full, and then is pushed downwardly some more to be able to put a little more waste in it. This creates pressure in the bag lower part, in particular, that is still contained by the wastebasket side wall, and that pressure can cause a forced sealing action between the exterior of the trash bag and the interior of the typical wastebasket, that takes place along a broad lower band of several inches surrounding the bag. This effectively seals the bottom area that may still have a little air trapped in it Besides just being heavier, the sealing action of such an over-full bag leaves little or no opportunity for air to flow past the bag and into the space, under the bag that is spaced between the bottoms of the wastebasket and the filled trash bag, being enlarged as the bag is pulled out of the wastebasket. Pulling the bag upwardly out of the wastebasket finds that the resistance of that seal to let the flow of some outside air to enter and fill the increasing space causes a sub-atmospheric pressure to be in the under-the-bag space that must be overcome by pulling the bag out anyway. Usually, the trash bag bottom and sides near its bottom has to be pulled as much as half way or more out of the basket before the seal created along a band area of the bag is relaxed as the upward movement of the bag continues. If the wastebasket has an outwardly tapered inside surface extending from the wastebasket bottom to its open top, the cross-section of the waste bag increases, and the forces pushing the trash bag against the wastebasket interior wall decrease. So, there are two parts to this separate problem: (1) the typical currently existing wastebasket is sufficiently stiff in all directions so that it will not expand when the bag inside it is being overstuffed, and (2) there is difficulty in lifting the filled bag. and even greater difficulty in lifting a heavy and also over-filled bag out of the wastebasket, due in part because the space under the bag has a partial vacuum created in it as the bag is being pulled out of the wastebasket. There have been proposals to put relief openings in the lowest part of the wastebasket or even in its bottom. Other proposals involve making a pipe as a part of the wastebasket that extends upwardly from the wastebasket bottom to its top, so that outside air can be taken into the bottom space as the bag is being moved out. The relief openings weaken the bottom and lower part of the basket, and the basket can be standing in just a little water and the bag interior is immediately wetted The pipes are more costly to make and still must be kept clear of debris, mold, and such that there is always the problem of keeping an open air passage through the pipe. The potential, and often real, first problem led to the invention, and then it was recognized that the wastebasket construction herein disclosed and claimed also solved the second problem.

FIELD OF THE INVENTION

The invention relates to a wastebasket that makes it extremely easy and very simple to put a plastic bag inside the wastebasket, retain the bag in the wastebasket until the now-filled plastic bag needs to be removed, then remove and dispose the waste materials that have been put into that trash bag, and easily install another trash bag.

The invention also relates to that same wastebasket that will also allow an oversized or expandable trash bag placed in it to expand beyond the normal allowed room for trash bags when packed, and without creating a large sealed air space to be formed near the bottom of a standard-type wastebasket by the filled trash bag's pressing against an uninterrupted area to form a seal between the trash bag and the wastebasket. That makes it very difficult to pull the filled or overfilled trash bag out of the wastebasket, making it much easier to remove a filled bag, and also making it easier to place an empty bag back in the wastebasket without trapping air within the wastebasket so that it is difficult to fully open the trash bag from top to bottom, and have the installed trash bag to be fully open throughout its depth for the reception of waste.

DESCRIPTION OF THE RELATED ART

There are systems for retaining plastic trash bags in wastebaskets, such as using a rubber band as noted earlier, or bungee cords; or providing clasps to grip the trash bag at its open end, and arrangements where the excess part of the trash bag being installed can have some sharp plastic hooks built into the wastebasket over which the trash bag excess part at the bag top is hooked, often making a hole in the trash bag material in doing so, as well as sticking the hand of the installer, because such hooks have sharp ends to pierce the trash bag when their top is pushed over them. Such wastebaskets use trash bags that are larger, at least in circumference, relative to the wastebaskets.

BRIEF SUMMARY OF THE INVENTION

The invention includes a wastebasket that has one or more, but often just two, openings in the side wall of the wastebasket. These openings may be relatively narrow slots, or wider ones, that extend from the top of the wastebasket near to but still spaced from the bottom of the wastebasket. The side wall (when the wastebasket is round or made like an inverted truncated cone) or walls (when the wastebasket is square or rectangular so that there are several walls joined together) still retain their shape but allow for some resilient movement in a cantilever manner. The invention employs their plastic memory trait of always trying to return to their free original position when not prevented form doing so.

There are two types of movement of at least one wastebasket part, and preferably with two or more wastebasket parts, associated with the openings that this construction can accommodate. In the first, the resiliency of the side walls will be used to secure a plastic bag to the top of the wastebasket. Specifically, the side wall sections will resiliently resist an inward type of movement, in a cantilever manner, so that the plastic bags whose open end is just slightly smaller in their open circumference than the outside circumference of the wastebasket at the open top of the wastebasket, whether that open top be of a round, partly round or straight-sided, oval, oblong, square, rectangular or other-shaped multi-sided wastebasket formed by one or more wastebasket side walls and a bottom connected to the bottom ends of said one or more side walls. The upper ends of the side-wall sections are moved inwardly, towards each other, enough to have the trash bag's open end pulled over them and hold them within that trash bag open end. When the side wall sections are released, they return part way to their normal free positions, and are retained from moving further by the narrower circumference of the trash bag opening, thus holding the trash bag in place.

The second type of movement relates to the holding capacity of the wastebasket. Here, since the side walls have their normally free positions, so that they have the general appearance of the usual wastebaskets, they will also yield to internal, outwardly directed pressures so as to be bent outwardly to some extent. Specifically, at times, the wastebasket may not be emptied in time, and the extra trash put into the trash bag will be somewhat relieved by some outward, also cantilever type, movements of those side wall areas that are quite close to the slots or openings to the extent accommodated by the trash bag.

BRIEF DESCRIPTION OF THE DRAWINGS

FIG. 1 is a side elevation view of one wastebasket embodying the invention.

FIG. 2 is another elevation view of another side of the wastebasket of FIG. 1, taken in the direction of arrows 1-1 of that figure.

FIG. 3 is a view of the top of the wastebasket of FIG. 1, taken in the direction of arrows 3-3 of that figure.

FIG. 4 is a side elevation view of the wastebasket of FIG. 1, showing the flexible sides held inward of their normal position by a trash bag having a slightly smaller circumference than the outside circumference of the wastebasket at the open top of the wastebasket.

FIG. 5 shows the wastebasket of FIG. 4 after the sides have been released, and their return to the extent permitted by the trash bag, the trash bag still holding the flexible sides slightly bent inward.

FIG. 6 shows a modified wastebasket which has downwardly extending openings in the side sections, the openings having parallel sides that are laterally spaced apart.

FIG. 7 is a top elevation view of the wastebasket of FIG. 6.

FIG. 8 is an elevation view of an alternate embodiment of a wastebasket according to the present invention.

FIG. 9 is a top elevation view of the wastebasket of FIG. 8, taken in the direction of arrows 9-9 of that FIGURE.

FIG. 10 is a side elevation view of the wastebasket shown in FIG. 1, holding a trash bag, which is usually one that has a larger circumference than the wastebasket, having been overstuffed so much with the trash that the edges of the vertically extending slot or opening edges have been forced slightly outward by the pressure of the overstuffed trash bag.

FIG. 11 is a side elevation view of the overstuffed trash bag and wastebasket of FIG. 10, taken in the direction of arrows 11-11 of that FIGURE.

FIG. 12 is a side elevation view of still another wastebasket embodying the invention, showing the downwardly extending slot or opening of a more decorative nature, using a serpentine shape.

FIG. 13 is a side elevation view of a wastebasket having a different opening presentation that, while extending downward, extends diagonally rather that vertically as shown in FIGS. 1, 6 and 10.

DETAILED DESCRIPTION OF THE INVENTION

In any configuration of the wastebasket embodying the invention, such as that shown in FIGS. 1-3, there are two or more wastebasket side walls that are separated by the two or more slot-type openings in as least one, but more often two, and sometimes more openings, in the side wall or walls. When there is a plurality of openings, they are preferably equally spaced apart at the wastebasket open top, extending downwardly from the wastebasket open top to a low point that is slightly above the wastebasket bottom. If there should be only one such opening, however, the invention can also be practiced, but at times not so easily. In any event, each such opening will have two generally downward-extending edges defining the opening so that those edges of each of the openings are parts of two or more side wall sections. There will be one such side wall section for each of the openings, with each of the two or more side wall sections having edges defined by two of the downward openings. The side wall sections are made of a plastic that has a plastic memory-recovering characteristic that allows each of them to be sufficiently flexible to have their uppermost ends resistively pushed inwardly toward each other, reducing the effective circumference of the top opening of the wastebasket so that the trash bag open end is just folded outwardly and over the wastebasket's rim. The inwardly moved side wall sections are then released, and each of them immediately exerts an outward force on the trash bag open-end area, but does not move back to its free position because the smaller circumference of the open end of the trash bag, engaged by the upper ends of the side wall sections, successfully resists such movement. The plastic-memory forces of the side wall sections are therefore unable to be allowed to return to their free-position location because their upper ends are surrounded by the unyielding plastic bag's circumferential open end, and the trash bag is so retained. It is a very simple process. When the trash bag is to be removed, the two side wall sections are again pressed inwardly until they no longer exert any force on the trash bag open end, and the bag is simply grasped and pulled out of the wastebasket. Because the lower ends of the slots or openings terminate shortly above the trash bottom, preferably at the same position which may be only about two inches above the bottom, that space between the bottom and the lower ends of the openings can be varied considerably, so that any liquid that may have leaked out of the trash bag into the bottom of the wastebasket will still be retained in the bottom of the wastebasket, assuming that it is not in such unusual large quantities that it would overflow through the openings' lower ends. Such liquids are usually just the remains of the drink in a one or a few drink containers that have been put into the trash bag, and that the bottom of the trash bag has leaked. The height of termination of the slots or openings is that which is considered sufficient to hold a reasonable volume of such liquids so that it is not spilled out of the wastebasket bottom. If the lower end of one of the openings should be slightly closer to the wastebasket bottom than any other opening end, it will be the one end that defines the top of the space that can contain fluid. This will make the removal of the trash bags easier because the pressure, particularly from the forcibly expanded trash bag is somewhat relieved. This is helpful only when the trash bag retention, noted above as a major part of the invention, is not being used. It is the force of those side wall sections trying to return to their unfettered positions that holds the trash bag, and it is that same trash bag that prevents those same side wall sections from moving slightly outward. This same action will take place, however, once the trash bag opening area that is fitted over the wastebasket has been removed. The outward movements of those side walls will lessen the grip that the wastebasket has on the side of the trash bag by increasing the wastebasket area when the trash bag open end is no longer held by the side walls. In either instance, when the trash bag has begun to be removed from the waste basket, there may be a momentary sub-atmospheric pressure in the space between the wastebasket bottom and the bottom of the relatively full trash bag. Once the bottom of the trash bag being removed passes the lower end of the slots or openings, the space that did have some temporary sub-atmospheric air, and that space is immediately fully open to atmosphere and thus no longer has any subatmospheric air pressure in the bottom of the wastebasket that resists removal of the trash bag. These slots or openings may be of several different shapes, some being only for the artistic effect rather than being just straight vertical slots or openings. There may be only one such slot or opening, but it is preferred that there be two or more such slots or openings so that there are two or more side walls acting on the trash bag to hold the trash bag in place as earlier described. Likewise, when the same side walls are being forced further outward from their free position, a bag therein that is being stuffed would not very likely act on just one side of the waste basket, but probably on each side of the slot or opening, to be bulging a bit while the others part of the wastebasket does not yield to bulging caused by the pressure when pushing the trash down to leave a little more room in the wastebasket. It is also contemplated, as part of the invention, to provide stiffening at or near the edges of the wastebasket formed by the slots or openings, so that the strips of wastebasket siding do not move easily outward beyond a reasonable limit. Other means may also be used to resist, or at times even prevent, much outward movements of the wastebasket strips or side walls that are between the slots or openings.

The wastebasket 10 of FIGS. 1, 2, and 3 has a rectangular shape, as seen while looking downwardly at the top of that wastebasket, and is so shown in FIG. 2. Wastebasket 10 has a side wall 12, a bottom 14, and a top opening 16 which is of the same shape as the bottom 14 but is larger so that the interior 18 of the wastebasket tapers inwardly from the top opening 16. Wastebasket 10 is shown as having two slots or openings, one opening 20 being in the section 22 of the side wall 12 and the other opening 24 in the section 26 of the side wall 15 which is opposite to the side wall section 22. The other sections 28 and 30 of the side walls 12 and 15 have no openings like the openings 20 and 24. In this arrangement, the openings 20 and 24 have diverging sides 34, with the bottom 27 of the openings being semi-circular. In the position shown, the side wall sections 28 and 30 are seen here on either side of the opening 20, with the opening 24 being behind the opening 20. These side walls 28 and 30, respectively, are connected with the parts of the section 26 of side wall 12 and other parts of the section 26 of the side wall 15, so that those side walls 28 and 30, and their respective sections of side walls 12 and 15, are integral, and can be flexed to an adequate extent either inwardly or outwardly of their free position shown. That would be toward or away from each other as they seen in FIG. 1. It is to be understood that the wastebaskets shown herein are all made of relatively flexible plastic material that has a strong plastic memory to try to return to their free positions shown when they are forced to be resiliently moved inwardly or outwardly against sufficient force urging them inwardly or outwardly.

The top opening 16 and the two openings 20 and 24 have an outwardly extending structure or rim 32, made as a bead or a planar part, outlining them and extending outwardly from the side wall sections 22, 26, 28, and 30, and the openings 20 and 24. The portions of structure 32 that are at the top of the side sections 28 and 30 may be extended outwardly to provide handles for lifting the wastebasket, as needed, as shown in FIG. 3. The structure also acts as a stiffening member that resists bending and movements of the parts that would be more likely to bend and move when the wastebasket is substantially full of trash. Depending upon the flexibility of the material of which the wastebasket is made, some excess flexability usually will require stiffening by the beaded edging all along the openings 20, as shown. Other, less flexible material of which the wastebasket is made, may dispense with some or even all of the beaded edging along the openings 20.

FIG. 4 shows the use of the invention in making it very easy to install and remove trash bags into and out of wastebaskets. As earlier noted, the wastebasket shown is the wastebasket 10 of FIG. 1, but the arrangement also applies to other wastebasket arrangements, including those of FIGS. 2 through 8. The only requirement for this use is the provision of trash bags 50 that are slightly smaller in circumference, particularly at the area of their open ends 52, than the inner circumference of the rim 32 that is located at the top opening 16 of the wastebasket 10. Each trash bag 50 should also be somewhat longer than the depth of the wastebasket, so that itsr bottom 54 can engage, or be quite near to, the bottom of the wastebasket while a part of itsr open end area can be placed over the wastebasket rim and down its outer side, or may extend longer down the outside of the wastebasket. FIG. 5 shows the wastebasket 10 and the plastic bag 50 in position, ready to receive trash, with the bag's being secured at its top and the main part of the bag well inside the wastebasket 10.

The wastebasket 110 of FIG. 6 also has a rectangular shape as seen while looking downwardly at the top of that wastebasket, as shown in FIG. 7. Wastebasket 110 has a side wall 112, a bottom 114 and a top opening 116 which is of the same shape as the bottom 114 but is larger so that the interior 118 of the wastebasket tapers downwardly and inwardly from the top opening 116. Wastebasket 110 is shown as having two slots or openings, one opening 120 being in the section 122 of the side wall 112 and the other opening 124 in the section 129 of the side wall 112 which is opposite to the section 122. The other sections 128 and 130 of the side wall 112 have no openings like the openings 120 and 124. In this arrangement, the openings 120 and 124 have parallel sides 134, with the bottom 126 of the openings being semi-circular.

The top opening 116 and the two openings 120 and 124 have an outwardly extending structure or rim 132, made as a bead or a planar part, outlining them and extending outwardly from the side wall sections 122, 128, 129 and 130, and the openings 120 and 124. Portions of structure 132 that are at the top of the side sections 129 and 130 are extended outwardly and may provide handles for lifting the wastebasket, as needed. The structure also acts as a stiffening member that resists bending and movements of the parts that would be more likely to bend and move when the wastebasket is substantially full of trash.

The structure or rim 132 is somewhat wider than the structure of rim 32 of FIGS. 1, 2, and 3. It is also rolled around so that it forms a tubular opening 135 in which the opposite ends 136 and 138 of a sliding rod 140 extend into those tubular openings across the top of the openings 120 and 124. The rod is spring-loaded to normally have the position shown in FIGS. 5 and 6, and may be moved sufficiently to latch it in place so that the openings 120 and 124 are not blocked, and can allow somewhat freer movements of the sections 122 and 128 than is allowed when the rod 140 is in its latched position shown.

The wastebasket 210 of FIGS. 8 and 9 is round in shape as seen while looking downwardly at the top of that wastebasket, as shown in FIG. 9. Wastebasket 210 has a circular side wall 212, a round bottom 214 and a round top opening 216 which is of the same shape as the bottom 214 but is larger so that the interior 218 of the wastebasket conically tapers downwardly from the top opening 216. Wastebasket 210 is shown as having four slots or openings 220, 222, 224 and 226 These openings are positioned in the side wall 212 at 90° intervals, as is best seen in FIG. 9.

The top opening 216 and the four openings 220, 222, 224, and 226 have an outwardly extending structure or rim 232, made as a bead or a planar part, outlining the and them, and extending outwardly from the side walls, and only the lower parts of the openings 220, 222, 224, and 226. The structure also acts as a stiffening member that resists bending and movements of the parts that would be more likely to bend and move when the wastebasket is substantially full of trash.

In one general configuration, as shown in FIGS. 1-3, 6 and 7, 10 and 11, 12, and 13, there are two or more wastebasket side walls that are separated by the two or more slot-type openings in at least one of the side wall or walls, and when being a plurality of openings being preferably equally spaced apart at the wastebasket open top, extending downwardly from the wastebasket open top to a low point that is slightly above the wastebasket bottom. If there should be only one such opening, however, the invention can also be practiced, but not as easily. In any event, each such opening will have two generally downward-extending edges defining the opening so that those edges of each of the openings are parts of two or more side wall sections. There will be one such side wall section for each of the openings, with each of the two or more side wall sections 28 and 30 having edges defined by two of the generally downwardly extending openings. The side wall sections are made of a plastic material that has a plastic memory-recovering characteristic that allows each of them to be sufficiently flexible to have their uppermost ends resistively pushed inwardly toward each other, reducing the effective circumference of the top opening 16, 116, etc., of the wastebasket and. the trash bag open end 52 is just folded outwardly and over the wastebasket's rim 32, 132, etc. The inwardly moved side wall sections are then released, and each of them immediately exerts an outward force on the trash bag open end area 52, but do not move back to their free position because of the smaller circumference of the open end 52 of the trash bag 50. Their plastic memory forces are therefore unable to be allowed to return to their free-position location because their upper ends are surrounded by the unyielding plastic bag's circumferential open end 52, and the trash bag 50 is so retained. It is a very simple process. When the trash bag 50 is to be removed, the two side wall sections 28 and 30 are again pressed inwardly until they no longer exert any force on the trash bag open end, and the bag is simply grasped and pulled out of the wastebasket. Because the lower ends 26, 126, etc., of the slots or openings terminate shortly above the trash bottom 14, 114, etc., preferably only about two inches, but that can be varied considerably, any liquid that may have leaked out of the trash bag 50 into the bottom of the wastebasket will still be retained in the bottom of the wastebasket, assuming that it is not in such unusually large quantities that it would overflow through the openings' lower ends. Such liquids are usually just the remains of the drink in a one or a few drink containers that have been put into the trash bag, and that the bottom of the trash bag has leaked. The height of the terminal ends 26, 126, etc., of the slots or openings is that which is considered sufficient to hold a reasonable volume of such liquids so that it is not spilled out of the wastebasket bottom.

FIGS. 10 and 11 show the wastebasket 310, which is the same as the wastebasket 10 of FIG. 1, with some trash 340 having been stuffed downwardly into a plastic bag 342 that had been earlier inserted into the wastebasket 310. Usually, the trash bag 342 is larger that the wastebasket 310 when persons tend to try to stuff more waste material into the bag. The relatively larger bag 342 also has an excess of material defining its opening, and this excess material is just gathered up or is tied with a knot to make it fit the top opening if the wastebasket 310. After the trash had been pushed and stuffed into the plastic trash bag 342, with the lower part of the trash bag's being filled even more densely near the wastebasket bottom 314, and still some trash 340 sticks up over the top of the wastebasket 310. In this description the wastebasket 10 of FIGS. 1, 2, and 3 are referred to, but it is to be understood that this description of FIGS. 10 and 11 generally relates to all of the wastebaskets shown in the drawings. When the plastic trash bag 342 was inserted into the top opening of wastebasket 310, or in any of the disclosed wastebaskets 10, 110, or 210, it can be moved downwardly more easily without any trapped air's being under it because of the openings 20 and 24, 120 and 124, 220 and 224, or 320, 322, 324, and 326. If necessary, the person putting it in can reach into at least the upper part of one of those openings and guide or pull the bottom of the trash bag 342 to be sure that it is down sufficiently and fitted at least close to the interior wall of the sections of the basket side wall. It is also a usual practice to place both hands into an opened plastic trash bag 342 and keep them there, spread apart to keep the trash bag reasonably open. After the bag has been inserted into the wastebasket, hands spread the trash bag out so that little air is trapped under it but within the wastebasket 310. Even then, there is still some air trapped under the trash bag. As the trash is put into the trash bag, the bag fills up, and it will begin to engage the interior surfaces of the side sections 322, 326, 328, and 330 or the equivalent side sections of any of the other disclosed wastebaskets, or a standard type of wastebasket having no means provided particularly for this purpose. When the trash 340 is pushed further into the trash bag 342, it will cause there to be some pressure on the wastebasket inner walls 318. When that pressure builds up throughout the trash bag, the portions of the sides 322, 326, 328 and 330 will feel the pressure.

In a wastebasket having a solid bottom and sides, the pressure is still there, but the only things that try to yield to it are the trash and the trash bag that is inside the wastebasket. It that situation, the lower part of the trash bag, in particular, has a band that is particularly receiving more of the pressure against the wastebasket inner wall. In the wastebaskets herein disclosed and claimed, the pressure that would otherwise act particularly to form a band with high pressure that strongly resists any removal of the full trash bag. When using a wastebasket in accordance with the invention herein disclosed and claimed, that pressure can become sufficient to cause the wall sections 22 and 26, 122 and 126, 222 and 226, or 322 and 326, to move outwardly, yielding to that inside force caused by tightly stuffing trash into the trash bag and the wastebasket itself. This is shown in FIGS. 8 and 9. This yielding action lessens the pressure of the filled trash bag and therefore the sub-atmospheric pressure that was in the bottom of the wastebasket. When that overstuffed trash bag is being lifted out of the wastebasket, it will have less resistance to such movement at the beginning, and as soon as even a part of the trash bag clears the lowest part of the openings and can be lifted out much more easily. This advantage can even be felt when the trash bag is fairly full but has not been overstuffed.

While the disclosures in FIGS. 1 through 11 only show openings that are open from the top of a wastebasket downward and have straight sides, either diverging or parallel, it is within the purview of the invention to provide one or more openings similar to those openings at a diagonal angle to the vertical, curved, serpentine or sinuous, or even straight but zigzagged. They may be in shapes that are made with any combinations of these. The shapes of such openings may include artistic effects. Some of such openings may be in combination with a scene so that it appears that a part of the scene has moved when the part of the wastebasket defining the openings moves in response to being stuffed or overstuffed with trash, as shown in FIGS. 8 and 9. Even so, any such openings are considered to be equivalent to those shown when they function in the same manner when the wastebaskets are filled, and even more so when they function in the manner set forth when the wastebaskets are overstuffed. FIGS. 12 and 13 show two of such samples. The wastebasket 410, shown in FIG. 12, has an opening 412 that still extends downwardly, but is sinuous or serpentine in shape. The wastebasket 510 in FIG. 13 shows an opening 512 that still extends downwardly, but is diagonally positioned.

The invention claimed is:

1. A assembly comprising:

a) a wastebasket comprising a bottom and a side wall whose lower edge is contiguous with the circumference of the bottom and whose upper edge serves as a discontinuous rim defining an open top to the wastebasket, the side wall and the bottom defining the volume of the wastebasket, wherein the side wall comprises one or more wall sections, each having an interior and exterior surface, at least one of which has an opening extending from and including its upper edge towards the bottom of the wastebasket, said opening being defined by opposing edges in said wall section and an opening bottom, the side wall being made of a flexible and resilient material such that the side wall, in the absence of any forces acting upon said side wall or portion thereof, is in a free position but is capable of movement in the wall section about the opening when forces are applied to the side wall: the resiliency of the side wall biasing the wall sections to their free position such that when the forces are removed the wall sections return to their free position; and b) a trash bag comprising an open end, a closed end and a side wall whose lower edge is or is contiguous with the closed end and whose upper edge defines the open end; wherein the trash bag lies within the volume of the wastebasket with the exception of the upper edge of the trash bag which is folded over the rim of the wastebasket such that the total circumference of the rim of the wastebasket is within the fold of the upper edge of the trash bag, wherein the circumference of the trash bag at its open end is less than the outer circumference of the wastebasket along the upper edge of the side wall while in its free state such that the bias of the side wall of the wastebasket exerts an outward force against the folded over portion of the upper edge of the trash bag, thereby securely holding the trash bag in place.

2. The assembly of claim 1 wherein the side wall of the wastebasket has at least two openings, each extending from and including the upper edge of the side wall to a point at or near the bottom of the wastebasket, each opening equally spaced from the other.

3. The assembly of claim 1 wherein the side wall of the wastebasket has at least two wall sections each having an opening extending from and including its upper edge to a point at or near the bottom of the wastebasket.

4. The assembly of claim 3 wherein the at least two wall sections having the openings oppose one another.

5. The assembly of claim 4 wherein the openings also oppose one another.

6. The assembly of claim 1 wherein, in the free position, the edges of the one or more openings diverge such that the distance between the opposing edges of the openings is greater at one end than the other.

7. The assembly of claim 3 wherein, in the free position, the edges of the openings diverge such that the distance between the opposing edges of the opening is greater at one end than the other.

8. The assembly of claim 1 wherein, in the free position, the edges of the one or more openings are parallel to one another.

9. The assembly of claim 3 wherein, in the free position, the edges of the openings are parallel to one another.

10. The assembly of claim 1 wherein the one or more openings has a serpentine design.

11. The assembly of claim 3 wherein the openings have a serpentine design.

12. The assembly of claim 1 wherein the one or more openings is at a diagonal to the upper edge of the side wall.

13. The assembly of claim 3 wherein the openings are at a diagonal to the upper edge of the side wall.

14. The assembly of claim 1 wherein the opening extends from the upper edge to a point near, but removed from, the bottom of the wastebasket whereby the bottom and lower portion of the side wall, the portion below the bottom of the opening, define a shallow space that is capable of retaining fluids.

15. The assembly of claim 1 wherein the bottom shape, and hence the general cross-sectional shape, of the wastebasket is round, oval, square or rectangular.

16. The assembly of claim 14 wherein the cross-sectional shape of the wastebasket is square with the side wall having four wall sections, two opposing pairs, at least one opposing pair having an opening in each of the two wall sections.

17. The assembly of claim 14 wherein the cross-sectional shape of the wastebasket is rectangular and at least one opening is in each of the larger opposing wall sections.

18. The assembly of claim 1 wherein the cross-sectional shape of the wastebasket is round and the side wall has at least four equally spaced openings.

* * * * *